US007052298B1

(12) United States Patent
Cheng

(10) Patent No.: US 7,052,298 B1
(45) Date of Patent: May 30, 2006

(54) COMPACT TRAVELING-USE POWER ADAPTER STRUCTURE

(76) Inventor: Sheng-Hsiung Cheng, P.O. Box No. 6-57, Yunghe, Taipei 235 (TW)

( * ) Notice: Subject to any disclaimer, the term of this patent is extended or adjusted under 35 U.S.C. 154(b) by 0 days.

(21) Appl. No.: 10/994,302

(22) Filed: Nov. 23, 2004

(51) Int. Cl.
*H01R 29/00* (2006.01)

(52) U.S. Cl. ..... 439/171; 439/103; 439/651

(58) Field of Classification Search ..... 439/169–174, 439/131, 103, 651–652, 694; 363/143–146
See application file for complete search history.

(56) References Cited

U.S. PATENT DOCUMENTS 5,159,545 A * 10/1992 Lee ..... 363/146
5,791,921 A * 8/1998 Lee ..... 439/172
6,302,717 B1 * 10/2001 Cheung ..... 439/172
6,544,051 B1 * 4/2003 Su ..... 439/131
6,659,782 B1 * 12/2003 Wu ..... 439/131

* cited by examiner

*Primary Examiner*—P. Austin Bradley
*Assistant Examiner*—Edwin A. Leon
(74) *Attorney, Agent, or Firm*—Troxell Law Office, PLLC

(57) ABSTRACT

A compact traveling-use power adapter structure comprises primarily a casing and several adjustable adapting plugs. The adjustable adapting plugs are installed on two sides at the bottom of the lower casing, and rotate toward a common grounding terminator in the center of the adjustable adapting plugs, thereby achieving the object of storage or opening for use. The two adjustable adapting plugs contain adjustable contact terminators, respectively. In using the aforementioned structure, a power plug of an electronic product is directly inserted into the power adapter, after rotating and opening the adjustable adapting plugs at the bottom of the casing, and adjusting the position or angle of their contact terminators, thereby improving the practicability and convenience.

3 Claims, 13 Drawing Sheets

COMPACT TRAVELING-USE POWER ADAPTER STRUCTURE

BACKGROUND OF THE INVENTION a) Field of the Invention

The present invention relates to a compact traveling-use power adapter structure, and more particularly to a compact traveling-use power adapter, with a small volume and rotational design, that can be widely applied in a variety of power plugs in many countries, for all kinds of electronic products.

b) Description of the Prior Art

In reflecting to a variety of power voltages and currents in countries all of the world, typical house-used electronic products have different power plugs and sockets to be in compliance with their own power voltages and currents. However, there are quite a few of power sockets with similar power voltages and currents. Therefore, in order to be able to use the house-used electronic products in different countries during traveling, a power adapter appears in a market. Referring to FIG. 1, it shows a power adapter a comprising a power plug a2 and a power socket a3 on a casing a1, using a one-to-one, one-to-two, and one-to-many styles. While in use, a power plug b1 of an electronic product b is inserted into the power socket a3 on the power adapter a, and the power plug a2 on the power adapter a is adjusted to be in compliance with the power socket a3 used in a country, such that the power plug b1 can be inserted. A connecting device a6 is installed between a socket port a4 and a plug port a5, which is used by the power adapter a to assemble different socket ports a4 and plug ports a5, without changing the power plug of an electronic product. However, due to large volume of a power adapter, it is inconvenient to carry or difficult to adjust the power adapter.

After decreasing the volume of an entire power adapter, the inventor uses a different design than the conventional assembling method, to install all the adjusting structures in the power adapter at the same time. While in use, via directly rotating a plug port out of a casing of power adapter, a power plug of an electronic product can be inserted into a socket port of the power adapter. Due to the advantages of compact volume, and easiness of operation, the practicability and convenience can be actually improved.

SUMMARY OF THE INVENTION

The primary object of the present invention is to provide a small and easy to carry compact traveling-use power adapter structure, having a variety of adapting styles for adjusting, and with practicability and convenience.

Accordingly, the present invention comprises primarily a casing and several adjustable adapting plugs. The casing is divided into an upper casing and a lower casing, wherein several slots of different styles are located on the upper casing. Several conducting clips are installed in the slots to clip in contact terminators of inserted electronic products, and connected with curve-shaped conductible metal plates between the upper and lower casing. Two adjustable adapting plugs are installed on two sides at the bottom of lower casing, respectively, with an L-shaped common grounding terminator in the center of the adjustable adapting plugs. Pivoting cylinders protrude from two corner sides of the common grounding terminator, such that the adjustable adapting plugs installed at two sides of the grounding terminator can be stored via inward rotating. One adjustable adapting plug consists of a flat and rotatable contact terminator installed on a rotating seat, and connected with the curve-shaped conductible metal plates between the upper and lower casing, using a conducting junction protruded from the rotating seat after installation. The other adjustable adapting plug consists of two cylindrical contact terminators installed on a clip-able rotating seat, and connected with the curve-shaped conductible metal plates between the upper and lower casing, using a conducting junction protruded from the rotating seat.

Accordingly, in using the aforementioned structure, a power plug of an electronic product is directly inserted into the slots at the top of the power adapter, and the position of adjustable adapting plugs is adjusted to be in compliance with the type of power socket used in a country. Thus, the room needed for storing two adjustable adapting plugs can be minimized, and a storage method which rotates the adjustable plugs towards the central common grounding terminator is taken, in order to assemble the socket port and the plug port into the same casing, thereby minimizing the entire volume used by the power adapter, and facilitating the easiness of carry. On the other hand, using a rotating method to take out the necessary adjustable adapting plugs, and choosing to retrieve or not to retrieve the central common grounding terminator with the same method as the adjustable adapting plugs, is very simple to operate. In addition, the flat contact terminators and the cylindrical contact terminators also contain adjusting structures, and thus can be used for a variety of power sockets. Accordingly, the present invention is very practical and easy to use.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
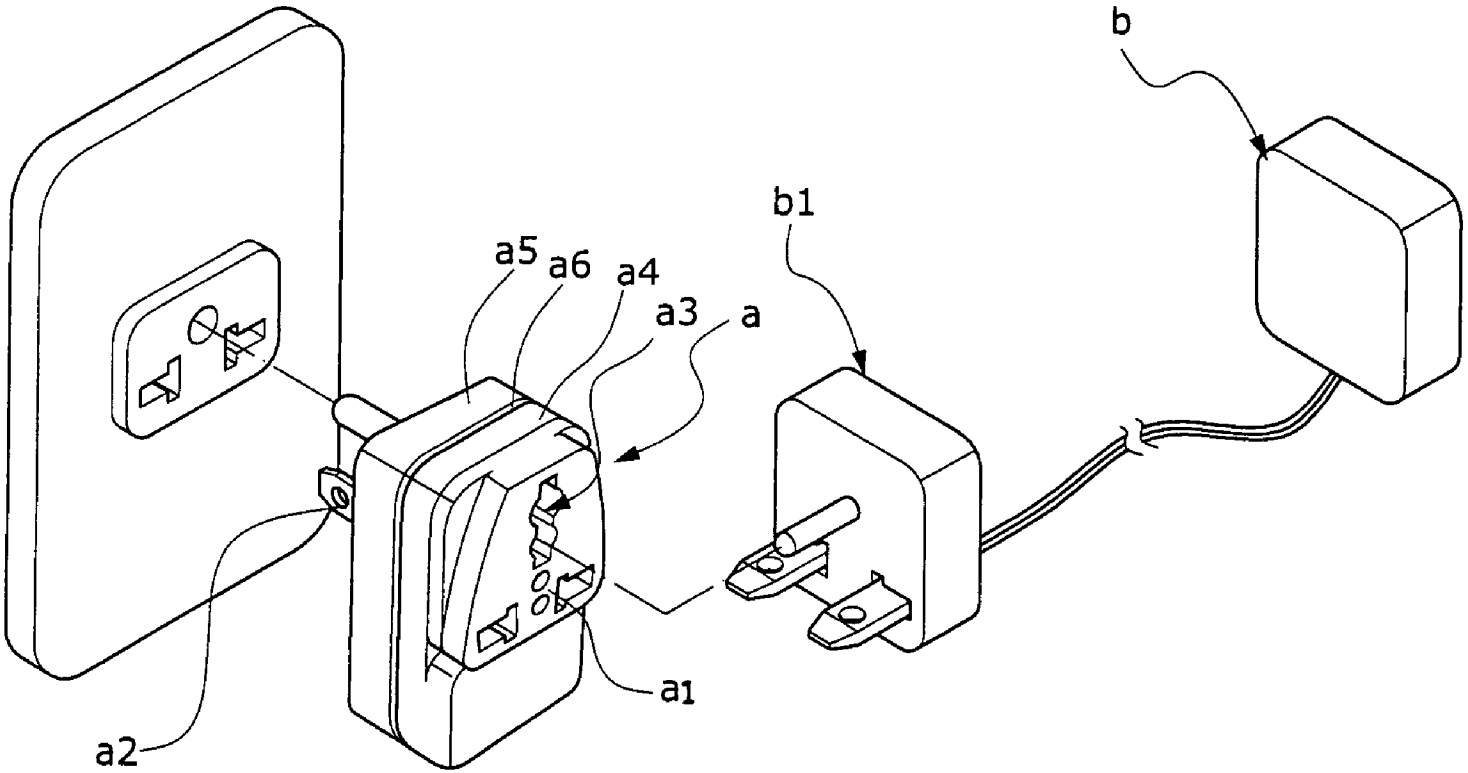
FIG.1 Prior Art
FIG. 1 shows a schematic view of a conventional power adapter.
Figure 2:
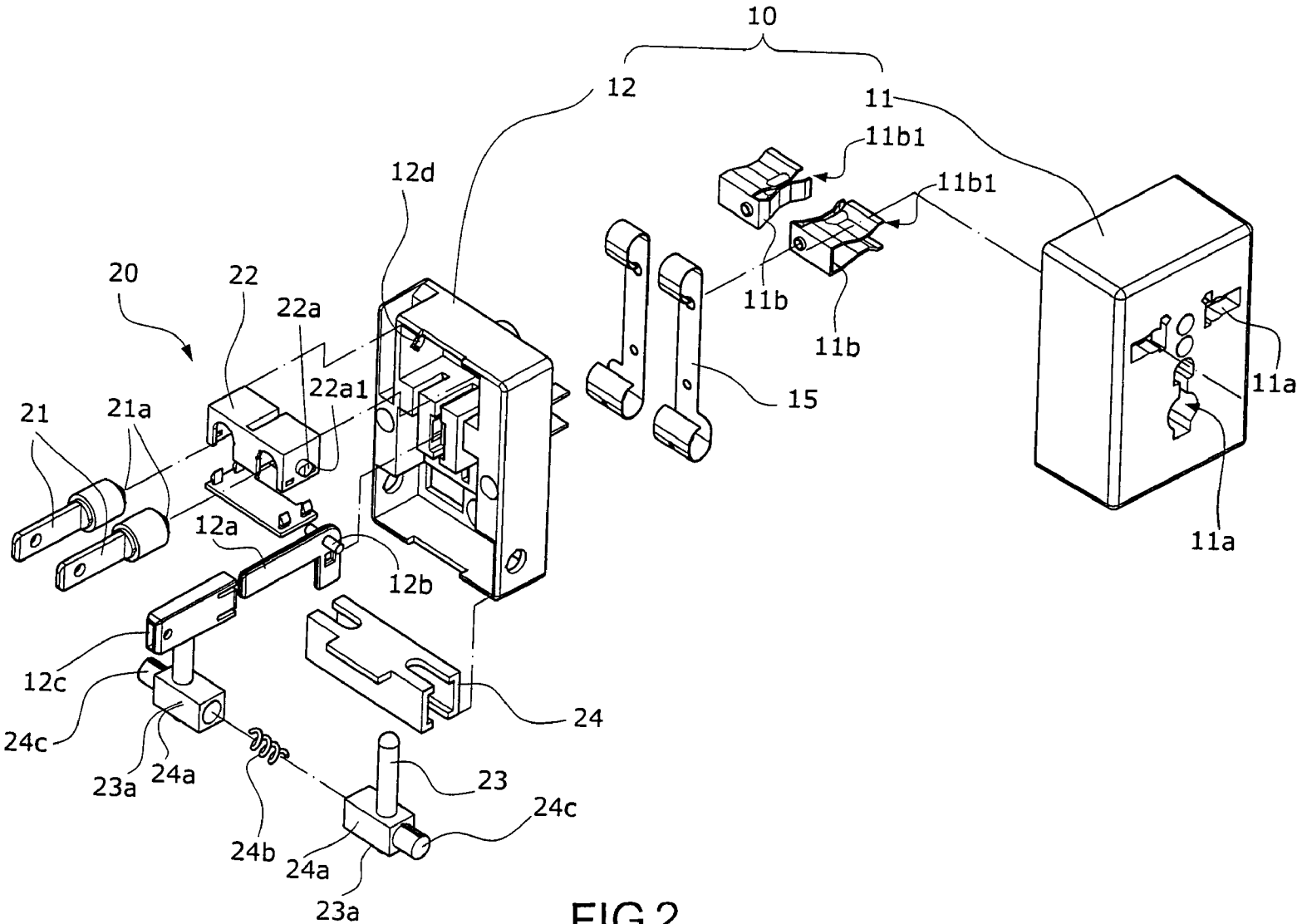
FIG. 2 shows a schematic view of compartments of the present invention.
Figure 3:
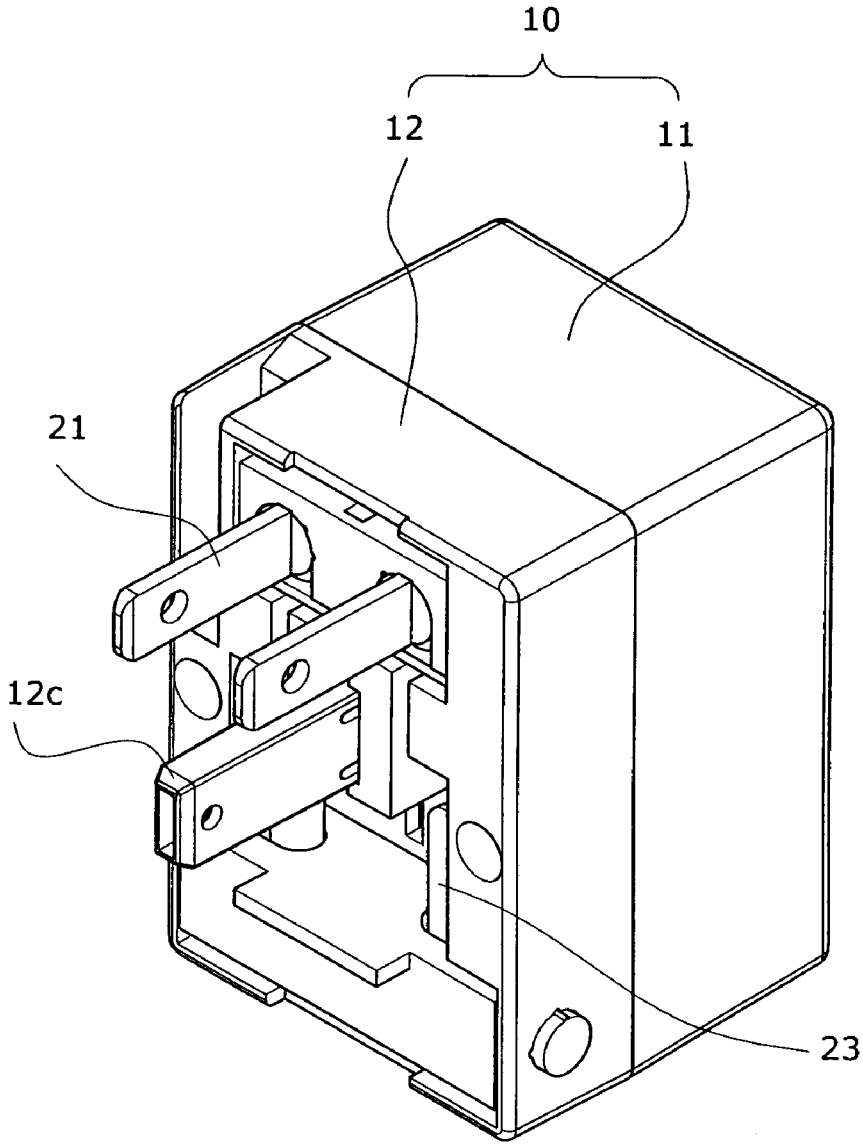
FIG. 3 shows a schematic view in assembling the present invention.
Figure 4A:
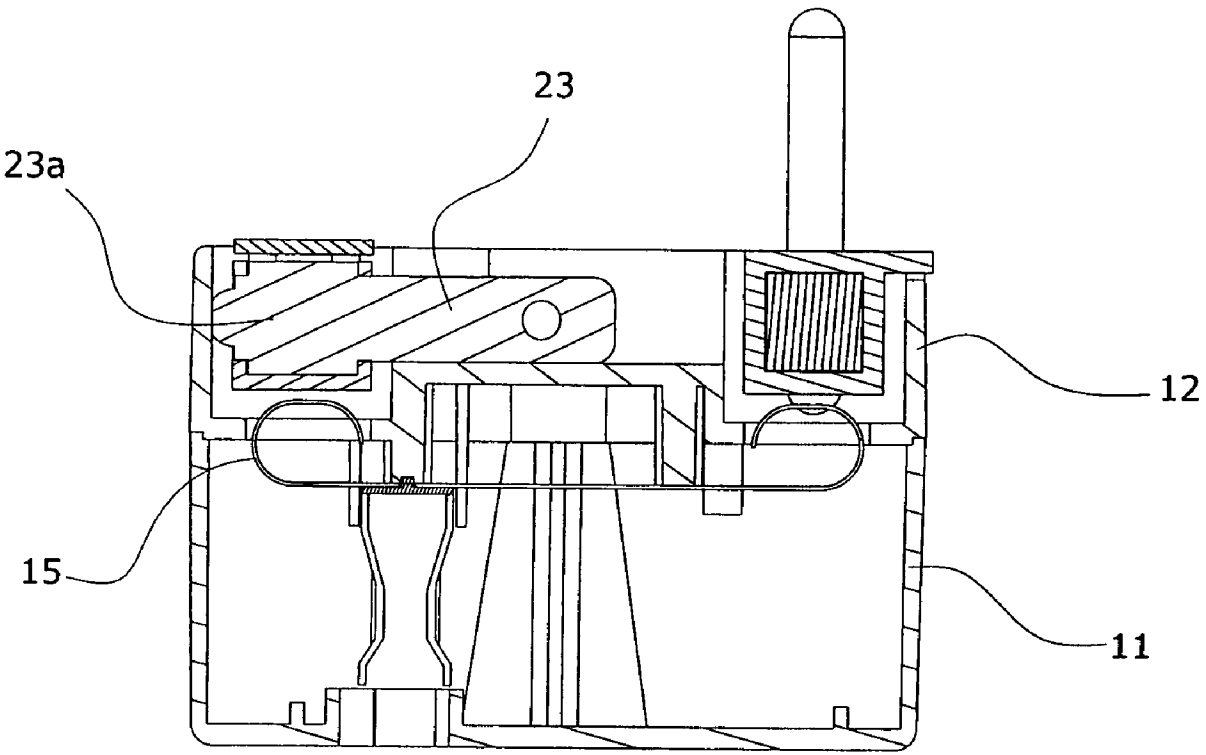
FIG. 4A shows a profile view in assembling the present invention.
Figure 4B:
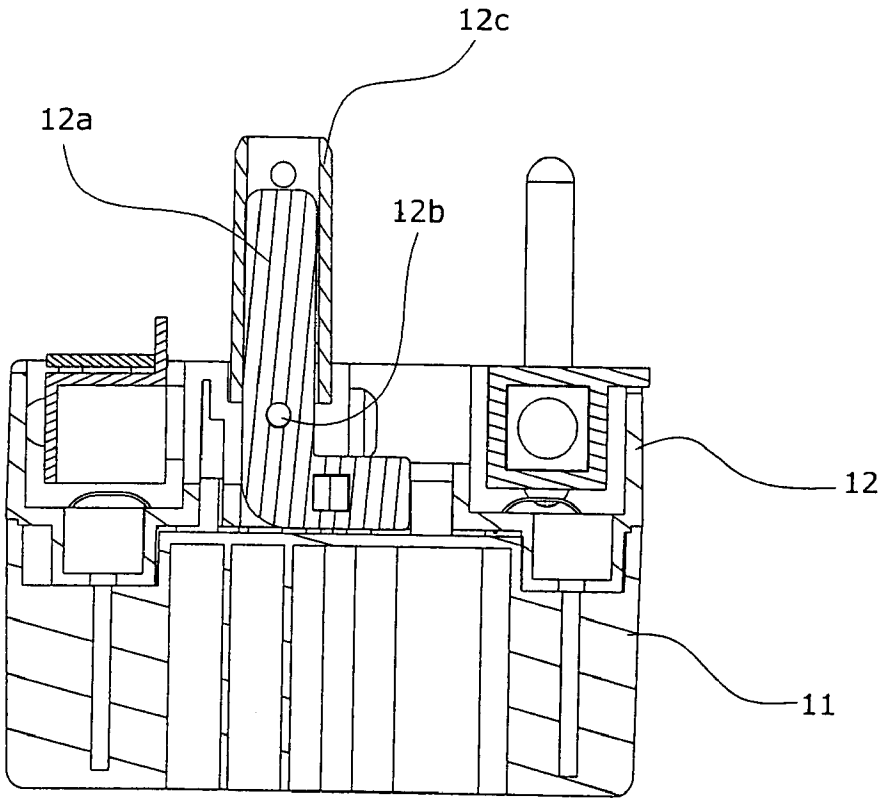
FIG. 4B shows another profile view in assembling the present invention.
Figure 4C:
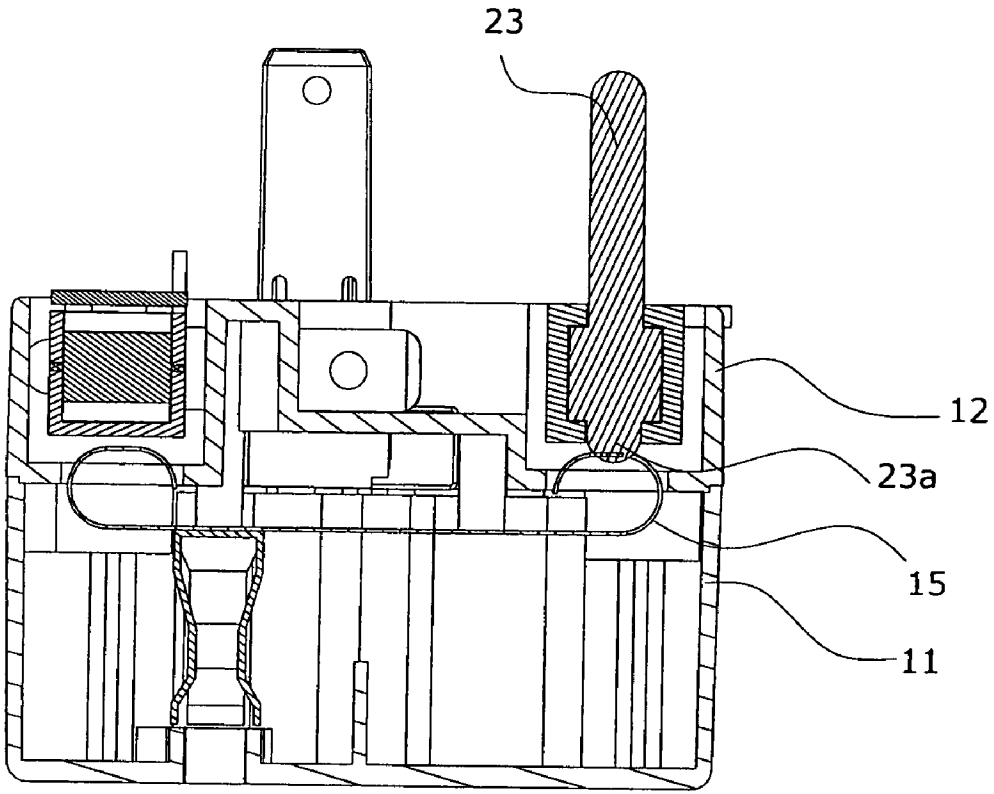
FIG. 4C shows a third profile view in assembling the present invention.
Figure 5A:
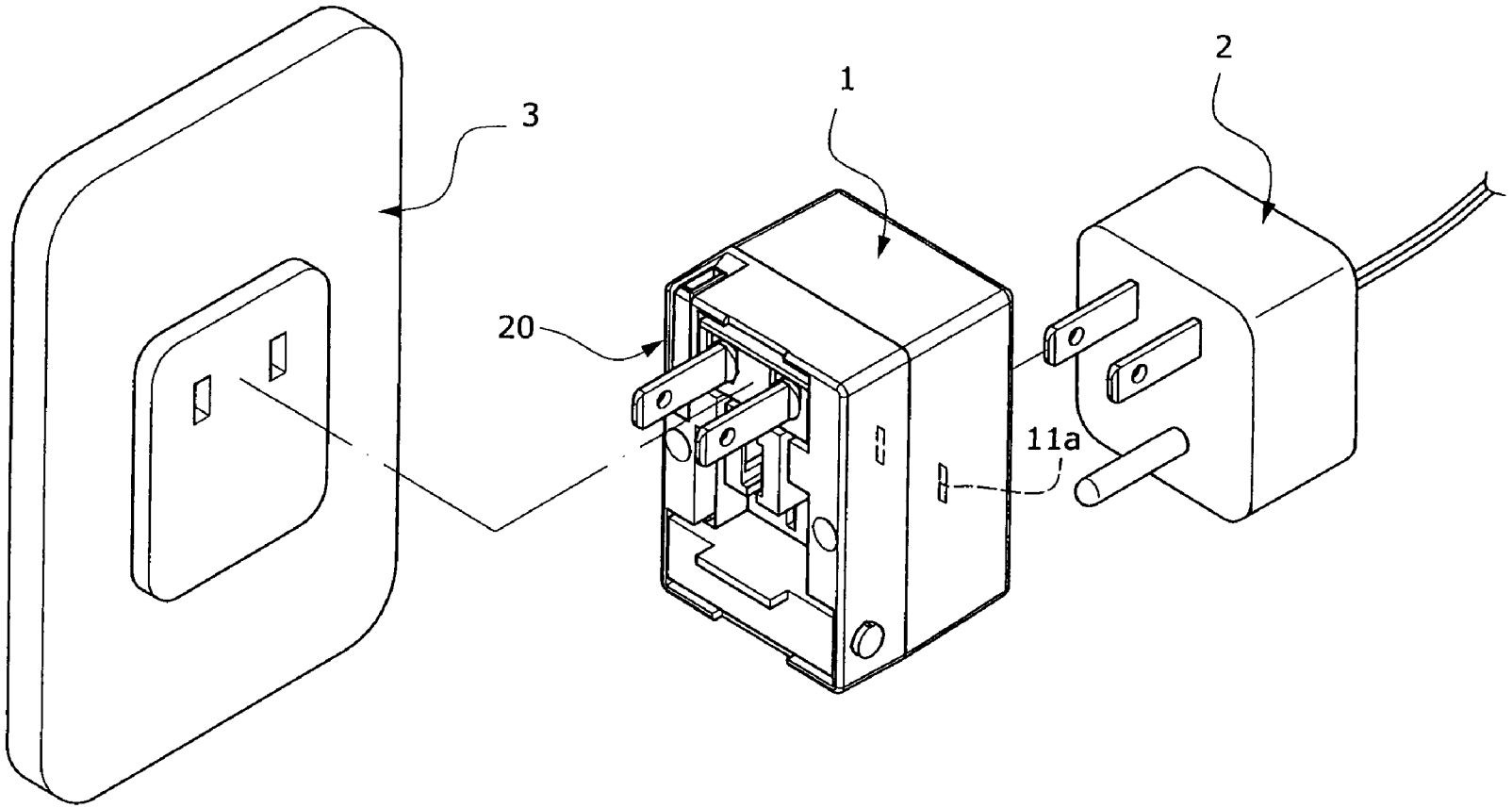
FIG. 5A shows a schematic view in applying the present invention.
Figure 5B:
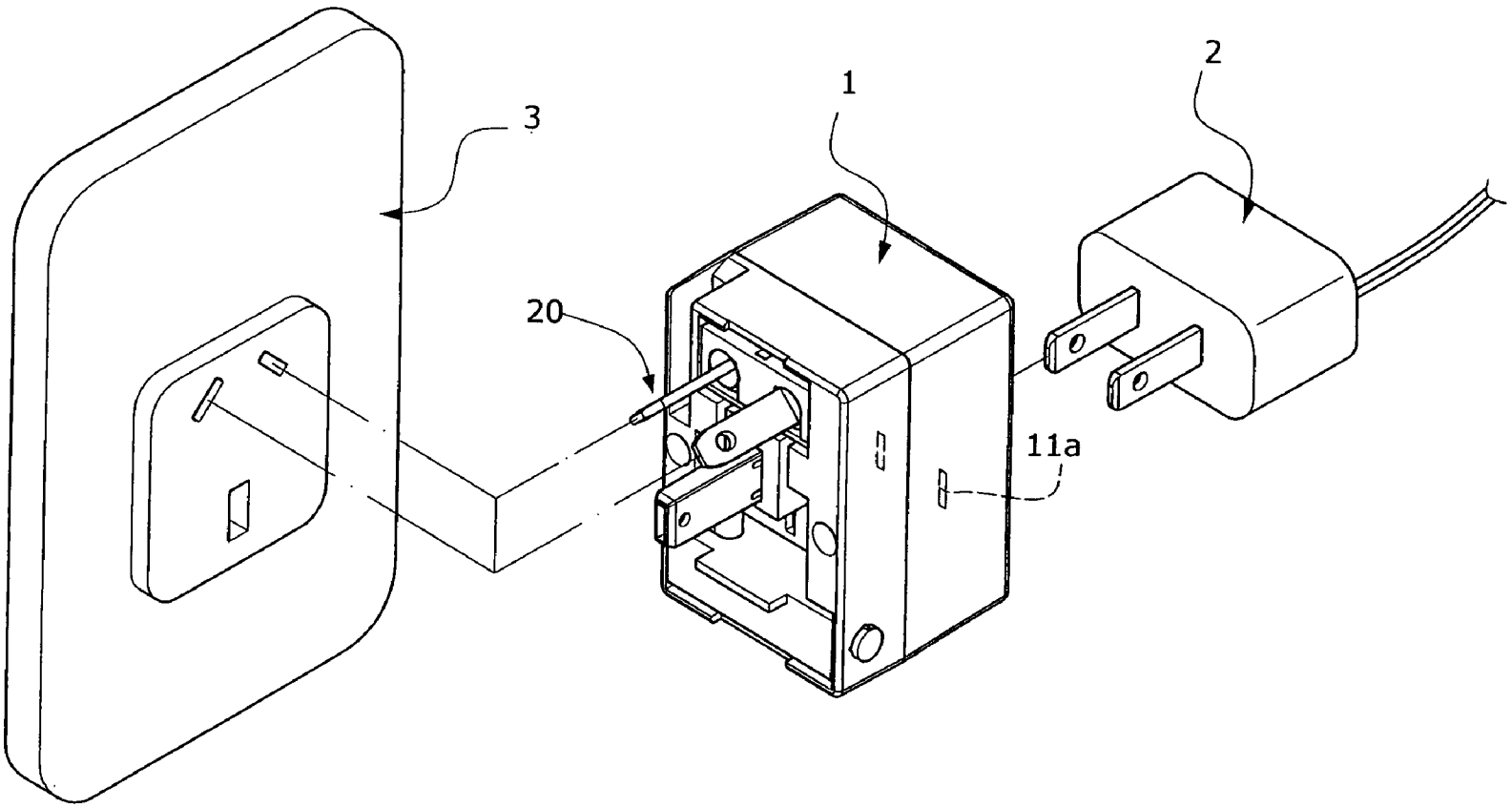
FIG. 5B shows another schematic view in applying the present invention.
Figure 5C:
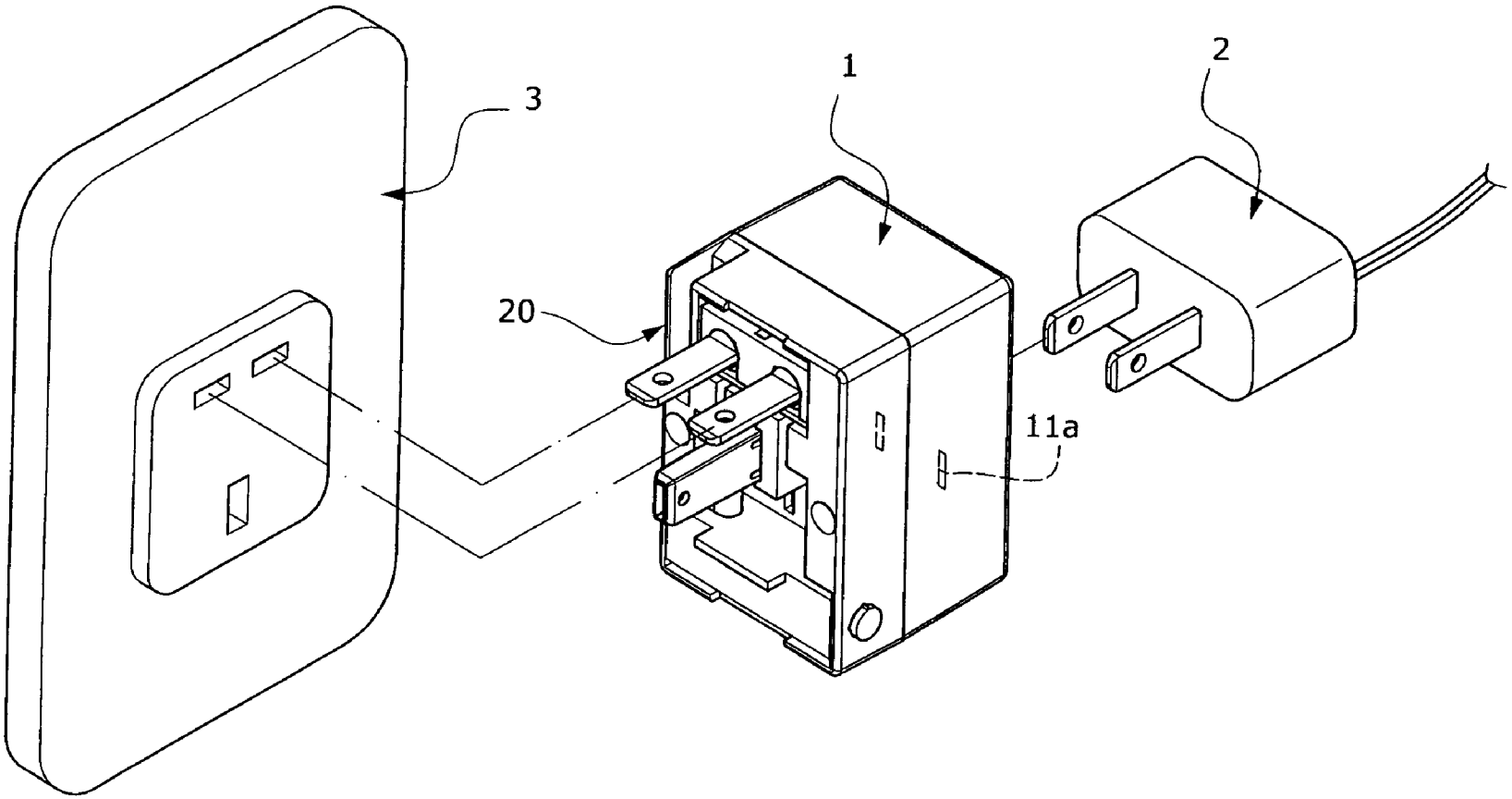
FIG. 5C shows a third schematic view in applying the present invention.
Figure 5D:
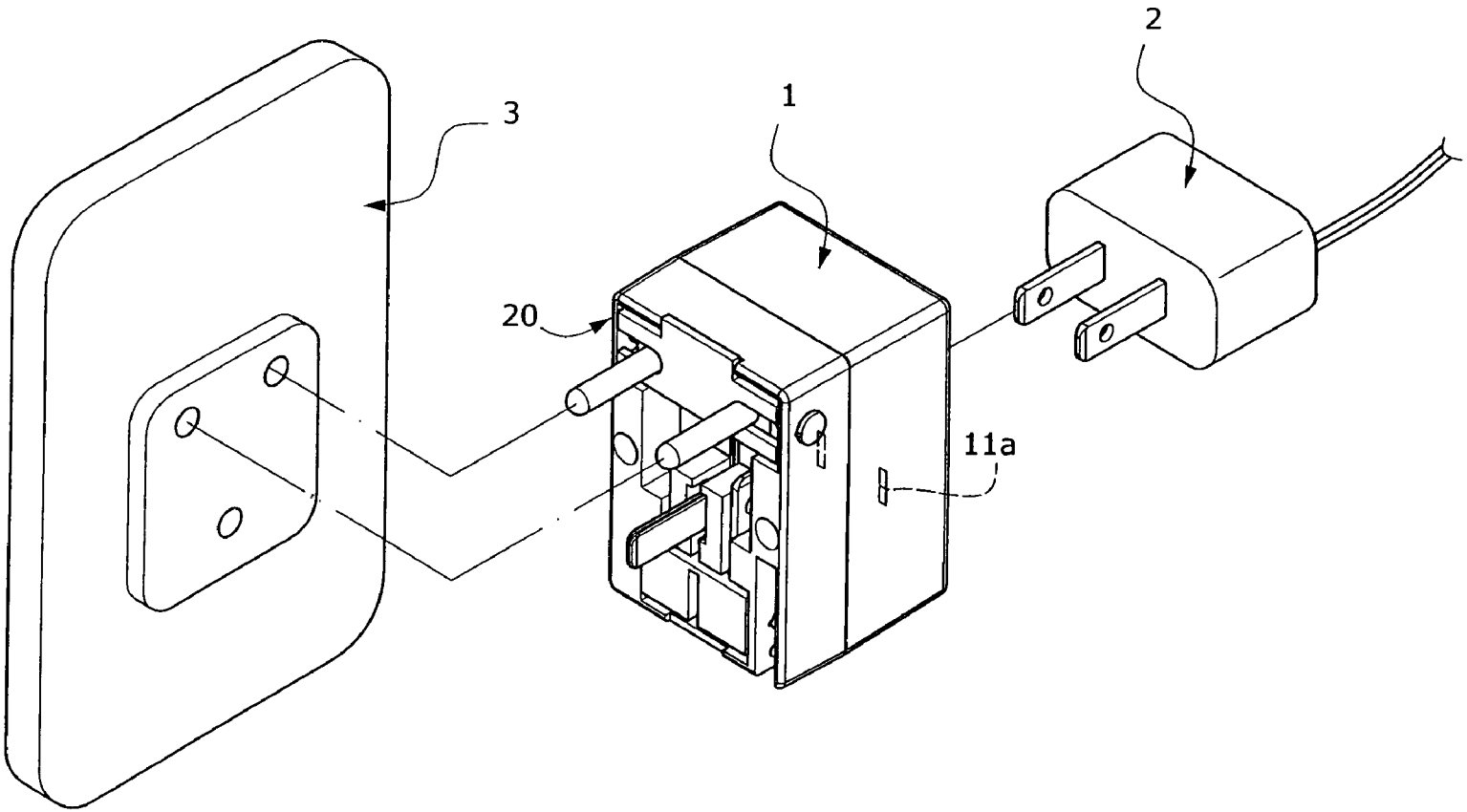
FIG. 5D shows a fourth schematic view in applying the present invention.
Figure 5E:
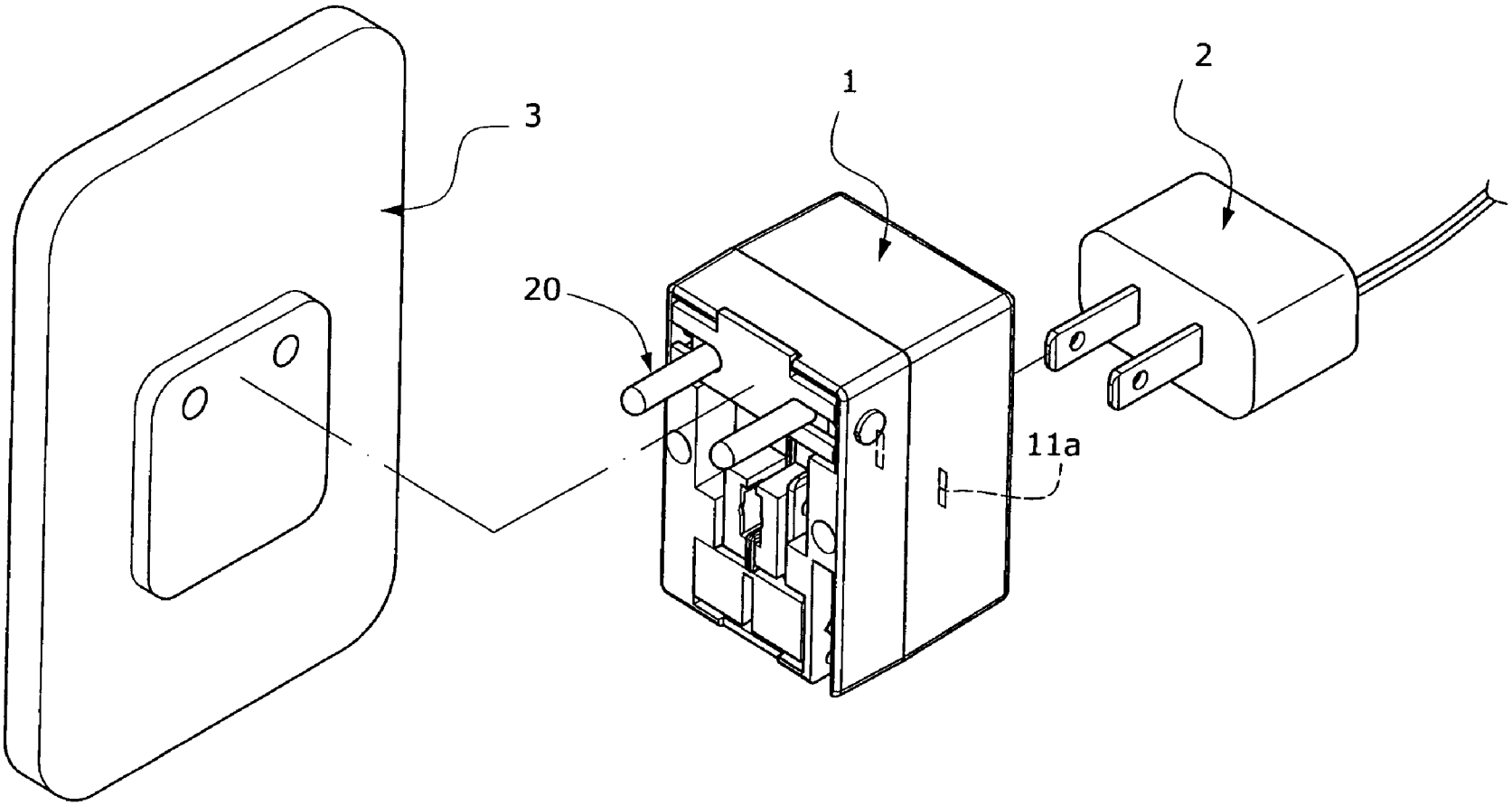
FIG. 5E shows a fifth schematic view in applying the present invention.

Referring to FIG. 2, FIG. 3, FIG. 4A, FIG. 4B, and FIG. 4C, the present invention comprises primarily a casing 10, and several adjustable adapting plugs 20, wherein the box-shaped casing 10 is assembled with a top casing 11 and a lower casing 12. Several slots of different types 11*a* are located at the top of upper casing 11, with corresponding conducting clips 11*b* inside the slots 11*a*, which will be aligned with clip parts 11*b*1 of the conducting clips 11*b*. The conducting clips are connected with curve-shaped conductible metal plates 15 between the upper casing 11 and lower casing 12, and the conducting clips 11*b* can clip in a power plug 2 of an electronic product inserted into the slots 11*a*. Two adjustable adapting plugs 20 are installed on two sides at the bottom of lower casing 12, respectively, with a common grounding terminator 12*a* installed in the center of the adjustable adapting plugs 20. A pivoting cylinder 12*b* protrudes from the corner of the L-shaped grounding terminator 12*a*, such that the adjustable adapting plugs 20 can be stored or opened for use, via inward rotating toward the grounding terminator 12*a* center, wrapped by a grounding cladding 12*c*. One adjustable adapting plug consists of two flat and rotatable contact terminators 21 installed on a rotating seat 22, with cylinders 22*a* protruding from two sides of the rotating seat 22. Positioning points 22*a*1 are located on the cylinders 22*a*, which are installed in corresponding positioning holes 12*d* of the lower casing 12. After installing the flat contact terminators 21 on the rotating seat 22, contact points 21*a* protruding from the bottom are connected with the curve-shaped conducting metal plates 15 between the upper casing 11 and lower casing 12. The other adjustable adapting plug 20 consists of two cylindrical contact terminators 23 installed on a clip-able rotating seat 24 The rotating seat 24 sits on two independent rotating seats 24*a*, connected by a spring 24*b*. Two positioning columns 24*c* protruded from the other ends of the independent rotating seats 24*a* without the spring 24*b* are installed at the corresponding positioning holes 12*d* of the lower casing 12, and pushed out of the lower casing 12. After installing the cylindrical contact terminators 23 on the independent rotating seats 24*a*, conducting junctions 23*a* at the bottom of the independent rotating seats 24*a* are connected with the curve-shaped conductible metal plates 15 between the upper casing 11 and the lower casing 12.

Referring to FIG. 5A, FIG. 5B, FIG. 5C, FIG. 5D, and FIG. 5E, which shows several schematic views of the implementation for the present invention, the power plug 2 of an electronic product is directly inserted into the slots 11*a* of the aforementioned power adapter 1, and the position of adjustable adapting plugs 20 of the lower casing 12 is adjusted to be in compliance with the usage of power socket 3 in a country.

Figure 6:
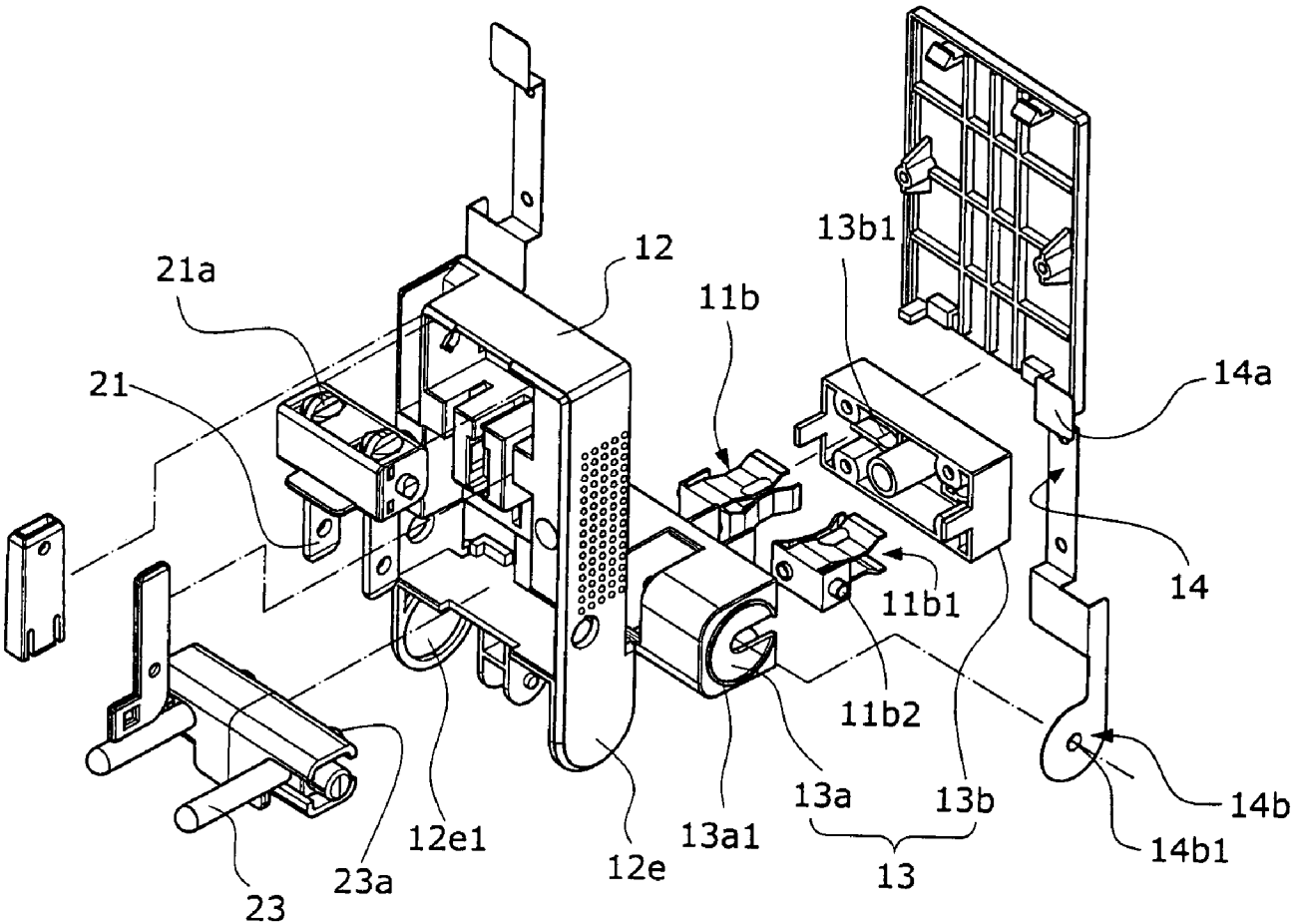
FIG. 6 shows a schematic view of compartments of another implementation of the present invention.
Figure 7:
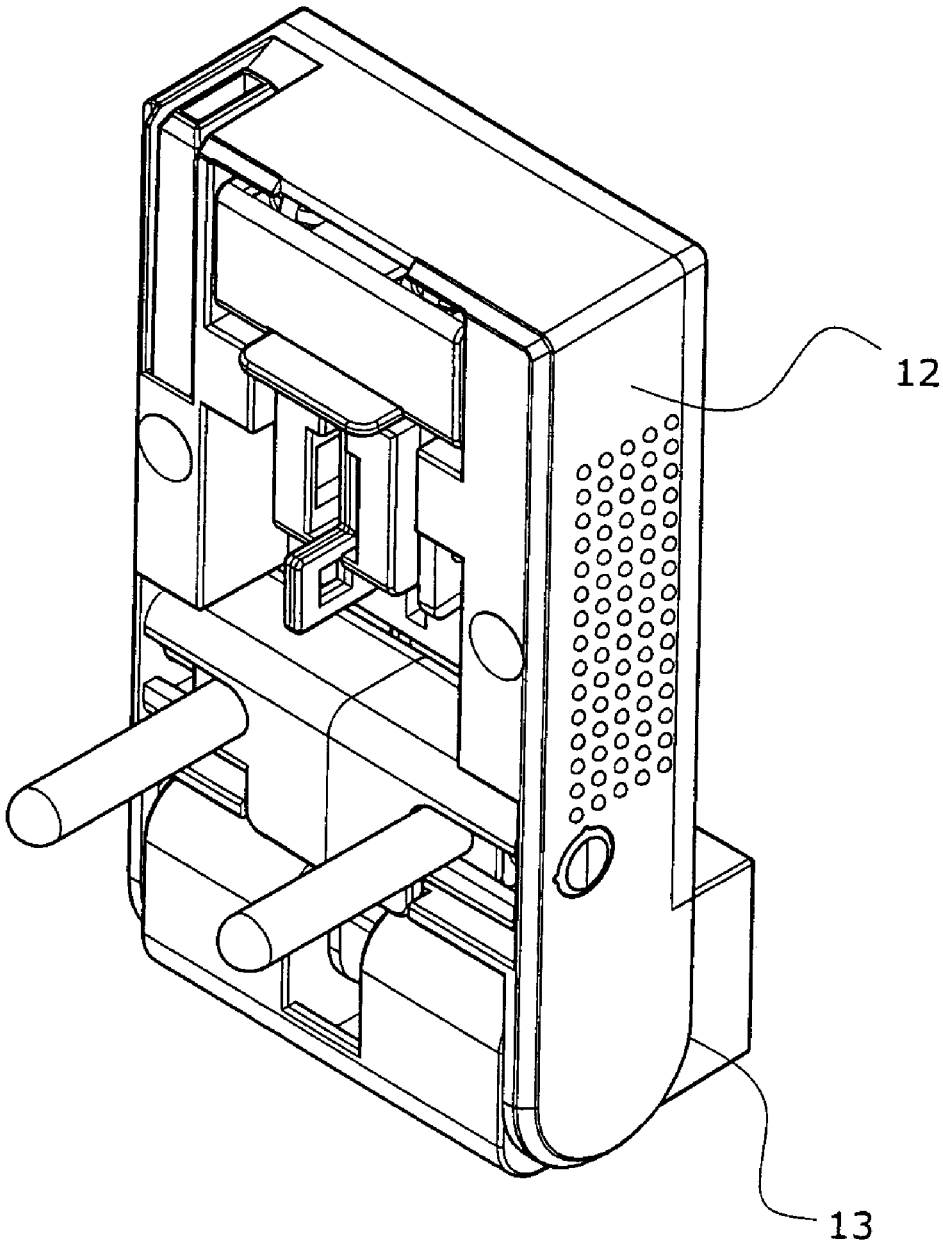
FIG. 7 shows a schematic view in assembling another implementation of the present invention.

Referring to FIG. 6 and FIG. 7, which shows two schematic views of a second implementation of the present invention, a lower casing 12 remains the same as the aforementioned first structure, with pivoting plates 12*e* protruded downward from two edges of one side of the lower casing 12. Circular slots 12*e*1 in the center of pivoting plates 12*e* can be used to install a rotating casing 13, and a conductible metal plate 14 is located between two pivoting plates 12*e* and the rotating casing 13. Two conducting parts 14*a* are located at the top of a conductible metal plate 14, and a rotating part 14*b* is protruded downward from one side of the conductible metal plate 14, with a circular hole 14*b*1 in the center of the rotating part 14*b*. Two conducting parts 14*a* can be connected with conducting junctions 21*a* and 23*a* at the back of a flat contact terminator 21 and a cylindrical contact terminator 23, respectively. The rotating casing 13 consists of a bottom casing 13*a* and a back casing 13*b*, with several different types of slots 13*b*1 on the back casing 13*b*. Corresponding conducting clips 11*b* are installed inside the slots 13*b*1, with clip parts 11*b*1 of the conducting clips 11*b* aligned with the slots 13*b*1 on the back casing 13*b*. A pivoting column 11*b*2 protruding from one side of the conducting clip 11*b* can go through the circular hole 14*b*1 of the rotating part 14*b* of the conductible metal plate 14, and convex parts 13*a*1, which are located at two sides at the bottom casing 13*a*, can be emplaced into the circular slots 12*e*1 in the center of pivoting plates 12*e*, correspondingly. Accordingly, the volume of the entire aforementioned power adapter can be reduced further, and the method of application still remains the same as the first implementation, thereby achieving the same object of the first structure of the present invention.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A compact traveling-use power adapter structure comprising:

a casing and several adjustable adapting plugs, with the casing assembled with an upper casing and a lower casing, wherein a plurality of slots in different styles are located at the top of the upper casing; corresponding conducting clips installed in the slots with clip parts aligned with the slots at the top of upper casing; conducting clips connected with curve-shaped conductible metal plates between the upper and lower casing, and clip in a power plug of an electronic product inserted into the slots; two adjustable adapting plugs containing adjustable contact terminators installed on two sides at the bottom of the lower casing, and via inward rotating toward a common grounding terminator center, which is located in the center of the adjustable adapting plugs, for storage or opening for use;

wherein one adjustable adapting plug consists of two flat and rotatable contact terminators installed on a rotating seat, with cylinders protruding from two sides of the rotating seat; positioning points located on the cylinders and installed in positioning holes of the lower casing; conduction junctions protruding from the bottom connected with curve-shaped conductible metal plates between the upper and lower casing, after installing the flat contact terminators on the rotating seat;

wherein the other adjustable adapting plug consists of two cylindrical contact terminators installing on a clip-able rotating seat sitting on two independent rotating seats connected with a spring; positioning columns protruding from the other ends of the independent rotating seats without the spring, installed in corresponding positioning holes of the lower casing and passed through the lower casing; conduction junctions protruding from the bottom connected with curve-shaped conductible metal plates between the upper and lower casing, after installing the cylindrical contact terminators on the rotating seat.

2. The compact traveling-use power adapter structure according to claim 1, wherein pivoting plates protrude downward from two edges of one side of the lower casing, with circular slots in the center of the pivoting plates, for holding a rotating casing; conductible metal plates installed between the two pivoting plates and the rotating casing, with two conducting parts at the top of the conductible metal plates, and a rotating part with a central circular hole, protruding downward and outward from one side; two conducting parts connected with conduction junctions at the back of the flat contact terminators and cylindrical contact; terminators.

3. The compact traveling-use power adapter structure according to claim 2, wherein the rotating casing consists of a bottom casing and a back casing, with a plurality of slots of different types on the back casing; corresponding conducting clips installed in the slots with clip parts aligned with the slots at the top of back casing; pivoting columns protruding from two sides of the conducting clips, passing through the circular holes of the rotating parts of the conductible metal plates; convex parts located at two sides of the bottom casing, emplaced into the circular slots in the center of the pivoting plates.

* * * * *